United States Patent [19]

Searingen et al.

[11] 4,242,870

[45] Jan. 6, 1981

[54] POWER SYSTEMS USING HEAT FROM HOT LIQUID

[76] Inventors: Judson S. Searingen, 500 Bel Air Rd., Los Angeles, Calif. 90024; Sham Sunder, 2235 Carmelina Ave., Los Angeles, Calif. 90064 (last known address)

[21] Appl. No.: 501,838

[22] Filed: Aug. 29, 1974 (Under 37 CFR 1.47)

Related U.S. Application Data

[63] Continuation of Ser. No. 321,810, Jan. 8, 1973, abandoned, which is a continuation-in-part of Ser. No. 174,774, Aug. 25, 1971, abandoned.

[51] Int. Cl.[3] ..... F01K 25/06; F01K 25/10

[52] U.S. Cl. ..... 60/651; 252/67; 60/671

[58] Field of Search ..... 60/651, 671; 252/67

[56] References Cited

U.S. PATENT DOCUMENTS

| | | | |
|---|---|---|---|
| 3,516,248 | 6/1970 | McEwen | 60/671 |
| 3,757,516 | 9/1973 | McCabe | 60/655 |

FOREIGN PATENT DOCUMENTS

| | | | |
|---|---|---|---|
| 465802 | 5/1937 | United Kingdom | 60/671 |

OTHER PUBLICATIONS

Nature's Teakettle, by HyDee Small, Geothermal Information Services, 1973.

*Primary Examiner*—Allen M. Ostrager
*Attorney, Agent, or Firm*—Browning, Bushman & Zamecki

[57] ABSTRACT

The present invention relates to power systems and more particularly to systems in which hot water from a natural well or spring is used to vaporize a working fluid which is then expanded to produce mechanical energy. Improved working fluids are used which comprise mixtures of several fluids so chosen and combined in such proportions that the hot water is used more efficiently with the mixtures than would be possible with their individual components.

12 Claims, 6 Drawing Figures

POWER SYSTEMS USING HEAT FROM HOT LIQUID

This is a continuation of application Ser. No. 321,810, filed Jan. 8, 1973 and now abandoned, which is in turn a continuation-in-part of application Ser. No. 174,774, filed Aug. 25, 1971 and also now abandoned.

BACKGROUND OF THE INVENTION

In many locations throughout the world there are formations near the earth's surface which have large quantities of hot water which can be used to produce mechanical energy. One way of utilizing this heat entails drawing the hot water from a natural spring or bringing it to the surface in a well and passing it through a heat exchanger, of the type capable of heating and vaporizing a fluid, in heat exchange relation with a working fluid of a character that it will be evaporated by such heat exchange. The working fluid is thus vaporized and sometimes superheated. The hot vapor is then expanded in an expansion engine to produce mechanical energy. It is then cooled and condensed so that it can be recycled. The water leaving the heat exchanger is returned to the same formation by means of a second well some distance from the producing well. This type of system absorbs most of the heat of the water at high temperatures as the preheat needed to bring the working fluid to its boiling point is usually only a small part of the total required heat.

One problem encountered in such systems is that of heat waste due to inefficient use of the hot water caused by the vaporization properties of the working fluids. Suppose the heat exchanger used is of the parallel countercurrent flow type. The temperature of the water at any point in such a heat exchanger must be higher than that of the working fluid at that point. Due to the latent heat of vaporization this temperature difference is usually very small at and slightly below the working fluid's initial boiling point and very large near the point at which the working fluid has absorbed its latent heat of vaporization and begins to superheat. Such small differences require excessive heat exchanger cost while the large ones cause power waste. For this reason, most such systems have used simple boilers as their heat exchangers. Boilers, however, are also inefficient because they are not capable of taking full advantage of the heat of the hot water and thus require large quantities of water.

One attempt to alleviate this situation might be to use the countercurrent type heat exchanger with a working fluid which requires a large amount of preheat and a small amount of latent heat of vaporization. This might alleviate the problem slightly, but has not been highly successful. There is still a "plateau" of constant temperature during vaporization of the working fluid which causes heat and power waste.

U.S. Pat. No. 3,516,248 to M. McEwen discloses the use of hydrocarbons as working fluids in such systems. These hydrocarbons present the problems described above. The McEwen patent states that it is possible to use mixtures of hydrocarbons in these systems. However, it does not recognize or deal with the above problems nor teach that it would be possible that suitable fluids could be chosen and so mixed as to alleviate these problems.

SUMMARY OF THE INVENTION

In the present invention a mixture of chemicals is used as a working fluid. The chemicals are so chosen and are mixed in such proportion that the mixture does not have a constant boiling temperature, but rather vaporizes over a desired range of increasing temperatures. This permits efficient use of a relatively simple countercurrent heat exchanger together with maximum use of the available heat energy in the water. Thus less water is used and various parts in the heat exchanger can be smaller, simpler and less expensive.

The type of working fluid contemplated by the present invention has a further advantage in that its expansion ratio is smaller due to a low latent heat.

A further advantage is that the working fluid condenses over a range of desired decreasing temperatures. Therefore, if water or air is used to cool the fluid in the condenser, less water or air is needed and the condenser too is less expensive.

It is therefore an object of the present invention to provide a power system utilizing a heating fluid for heating a working fluid in a most efficient and economical manner by providing a working fluid which vaporizes over a range of temperatures having the least practical variation in differential from the temperatures of the heating fluid with which it is in heat exchange relation.

It is a further object of the present invention to provide a power system working fluid which condenses over a desired range of changing temperatures.

Another object of the invention is to provide a power system working fluid which makes maximum use of heating and cooling media thereby reducing equipment cost.

Still another object of the invention is to provide a method of generating mechanical energy from hot water with minimum heat waste.

The accomplishment of these and other objects of the invention will be realized by means set out in the following description and the drawings wherein.

Figure 1:
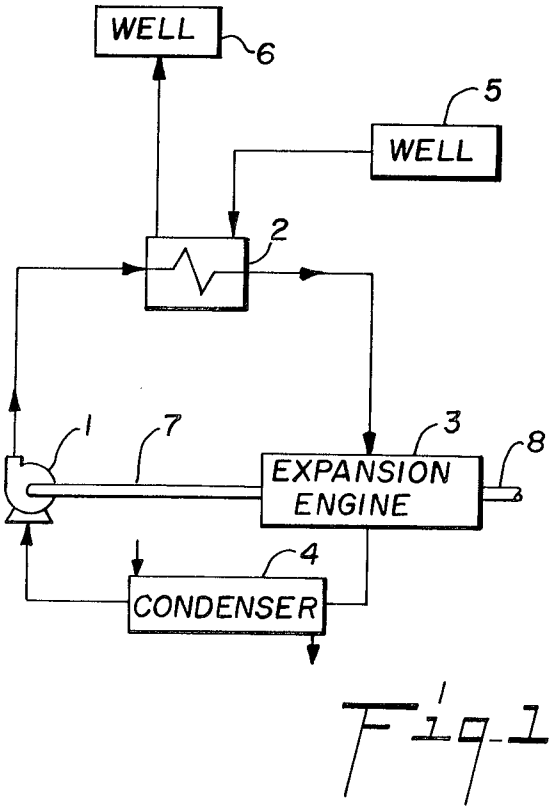
FIG. 1 is a flow diagram depicting the power system of the present invention.

Referring now to FIG. 1, a pump 1, preferably a centrifugal pump, is used to drive a working fluid through a heat exchanger 2 of the type capable of heating and vaporizing a fluid. Hot water is drawn from an underground formation by means of a well 5 and passes in countercurrent heat exchange relationship with the working fluid in the exchanger 2, vaporizing and preferably superheating it. The water is then returned to the same underground formation by means of another well 6. The hot working fluid vapor passes from the heat exchanger 2 to an expansion engine 3 such as a turbine. Here the vapor expands producing mechanical energy which may be used to drive the pump 1, as indicated diagrammatically at 7, as well as to do other work as indicated at 8. The expanded working fluid vapor next passes into a condenser 4 where it is cooled and condensed. It can then be returned to the pump 1 to be recycled.

While the invention is particularly useful in systems which use hot water from wells as the heating medium, it is not limited to such use but may be used with other heating media.

Figure 2:
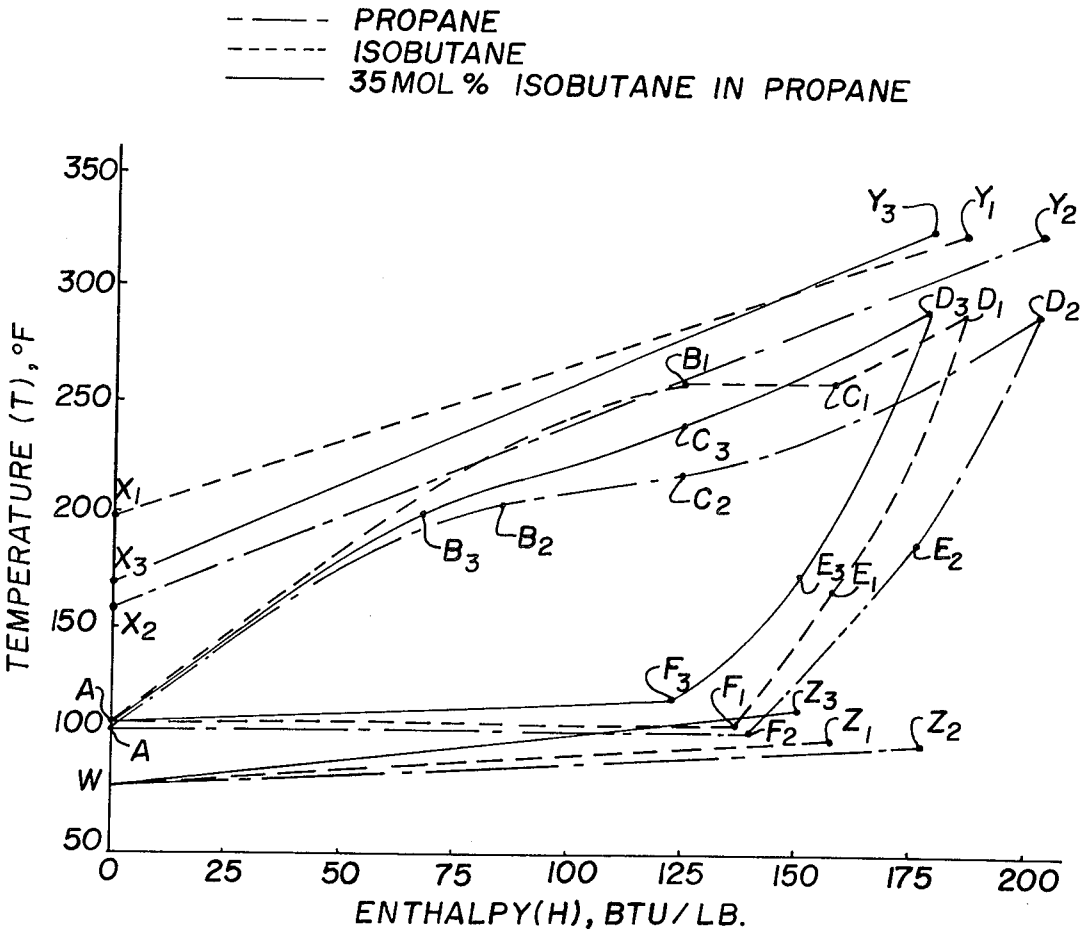
FIG. 2 is a temperature-enthalpy diagram for isobutane, propane, and a mixture thereof.

Referring now to FIG. 2, a graph is shown in which temperature T (the ordinate) is plotted against enthalpy H (the abscissa) for isobutane, propane, and a mixture of 35 Mol percent isobutane in 65 Mol percent propane. For practical purposes the term "enthalpy" is nearly identical to the term "heat". The graph will herein be referred to as a temperature-enthalpy or T-H diagram. The particular fluids discussed are here used as examples to illustrate the invention which is by no means limited to these fluids. While isobutane and propane are suitable for water being introduced into the system at about 325° F., hot water of other temperatures may require fluids of different characteristics.

In the T-H diagram of FIG. 2 the dashed line $AB_1C_1D_1E_1F_1$ represents isobutane as it passes through a power system such as the one shown in FIG. 1. The dashed line $Y_1X_1$ represents hot water running countercurrent to the isobutane in a heat exchanger. The dashed line $WZ_1$ represents cool water running countercurrent to the isobutans in a condenser (although other cooling media such as air would behave similarly and could also be used). The points $Y_1$ and W represent the initial temperature and enthalpy values of the hot and cold water respectively. The segment $AB_1C_1D_1$ represents the isobutane as it runs countercurrent to the hot water in the heat exchanger. The isobutane enters the heat exchanger at A at about 100° F., and a suitable pressure so that it is in liquid form. As the water moves through the heat exchanger it gives up its heat to the isobutane, and its temperature and enthalpy decrease. However, as the hot water is cooled, it encounters cooler and cooler portions of isobutane. Thus its temperature, as seen by comparing line $Y_1X_1$ and segment $AD_1$ is always higher than that of the isobutane so that its heat is used to heat the isobutane at all points in the heat exchanger. If the heat available in the water at the lower temperature were not useful, a much larger quantity of water would be required to produce boiling of the working fluid, as is the case where a simple boiler, rather than a countercurrent heat exchanger, is used.

The sensitive heat from the hot water is most efficiently used when the temperature difference between the hot water and the isobutane at each point in the heat exchanger is most nearly constant, i.e. when segment $AB_1C_1D_1$ is most nearly parallel to line $X_1Y_1$. Then since the line $X_1Y_1$ is always a straight line, it is desirable for the curved line segment $AB_1C_1D_1$ to be, as nearly as possible, a straight line, i.e., its slope or the rate of change of temperature with respect to enthalpy (dT/dH) should be as nearly constant as possible and as close as possible to the slope of $X_1Y_1$.

As the T-H diagram clearly shows, isobutane falls far short of these desirable qualities. The segment $AB_1$ represents the preheating of the isobutane. Near the boiling point $B_1$ the difference in temperature of the isobutane and the water, represented by the vertical distance between segment $AB_1$ and line $X_1Y_1$ becomes quite small. The "pinch zone" prevents a good transfer of the available heat which necessitates more expensive heat exchange equipment, which equipment either allows a greater volume of hot water to flow in this area or improves the heat transfer in some other manner.

The segment $B_1C_1$ represents the vaporization of the isobutane. Due to the latent heat of vaporization, the temperature of the isobutane does not charge along $B_1C_1$ as seen by the fact that the curve here forms a horizontal "plateau" of zero slope. The temperature of the water, of course, does change along the corresponding segment of $X_1Y_1$. Therefore, the temperature difference near $C_1$ becomes quite large. This represents a power loss or a waste of available heat.

At $C_1$ the isobutane is completely vaporized so that along $C_1D_1$ the temperature again rises as the vapor is superheated. The segment $D_1E_1$ represents the expansion of the vapor in an expansion engine such as a turbine whereby mechanical energy is obtained. This energy may be used for running the pump and for doing other work.

Segment $E_1F_1$ represents the cooling of the superheated vapor in the condenser and segment $F_1A$ represents condensation of the vapor. Segment $F_1A$ is a horizontal line of zero slope indicating that isobutane condenses at a constant temperature. Just as in the heat exchanger the hot water must always be above the temperature of the working fluid, the cooling water must always be below the temperature of the working fluid in the condenser. At the same time the cooling water must increase in temperature, i.e. line $WZ_1$ must have some positive slope, if it is to cool the isobutane. The greater the slope of $WZ_1$ the more efficiently it is being used. Since segment $F_1A$ is horizontal and line $WZ_1$ must stay below it, the slope of line $WZ_1$ cannot be very great. Therefore more cooling water must be used and the condenser is more expensive.

The dot-dash curve $AB_2C_2D_2E_2F_2$ represents propane as it passes through a similar power system. The dot-dash line $Y_2X_2$ represents hot water as it passes through the heat exchanger in countercurrent heat exchange relation with the propane, and the dot-dash line $WZ_2$ represents cool water passing through the condenser in heat exchange relation with the propane. Segment $AB_2$ represents preheating, segment $B_2C_2$ vaporization, segment $C_2D_2$ superheating, segment $D_2E_2$ expansion, segment $E_2F_2$ cooling, and segment $F_2A$ condensation of the propane. The hot water and propane are introduced into the heat exchanger at about the same temperatures as the water and isobutane respectively of the above example. The two points labelled A actually represent the same point. The A which occurs on the curve $AB_2C_2D_2E_2F_2$ is shown slightly below the A which occurs on curves $AB_1C_1D_1E_1F_1$ and $AB_3C_3D_3E_3F_3$ so that segments $F_1A$ and $F_2A$, which would otherwise substantially coincide, can both be seen.

The pressure used for the propane is here about the same as that for the isobutane above since we wish to compare the two under similar conditions.

Again there are undesirable features in the behavior of the working fluid as it passes through the heat exchanger. The curve does not closely approach a straight line, i.e. the rate of change of temperature with respect to enthalpy, represented by the slope of the curve, varies considerably as does the temperature difference, represented by the vertical distances from $X_2Y_2$ to $AB_2C_2D_2$. Again there is a pinch zone of small temperature differences along $AB_2$ near the initial boiling point $B_2$ representing excessive heat exchanger cost. The segment $B_2C_2$ is nearly horizontal with little temperature change, and again there is a zone of great temperature differences near $C_2$. Segment $F_2A$ is horizontal, since propane condenses at a constant temperature, so that the problems again occur in the condenser.

The present invention involves using a mixture of two or more ingredient fluids as a working fluid. The ingredient fluids should have essentially differing but moderately close boiling points for any given pressure. Preferably the range of vaporization temperatures of the resultant working fluid is continuous. The boiling points of the ingredient fluids should not be too close, or the "plateau effect" will not be eliminated. Yet they must be close enough to cause the vaporization of the mixture to fall within the desired range, proper choice of which is discussed more fully below. They are preferably also close enough to allow the ingredients to blend together in reasonably smooth flow and to make the range of vaporization temperatures continuous. Thus they should be moderately close, i.e. close enough to accomplish these ends, yet essentially differing, e.g. in a typical hydrocarbon system, if only two ingredients are used, the points might differ by about 50° F.

FIG. 2 shows that isobutane and propane satisfy these conditions. Their boiling points differ, yet are moderately close. They blend smoothly together, and each can be vaporized and superheated at the same pressure by water introduced into a heat exchanger at about 325° F.

Given two such suitable ingredient fluids, the present invention further involves mixing them in a suitable proportion so that the mixture does not have a constant or near constant boiling point, but rather vaporizes over a desired relatively wide range of continuously increasing temperatures.

By mixing various ingredient fluids, virtually any desired range of vaporization temperatures can be achieved. However, given a particular hot water source and system, a particular desired range of vaporization temperatures for the working fluid must be determined. Furthermore, the ingredients should be chosen and mixed in such proportion that the slope of a T-H curve for the working fluid will be as nearly equal as is practically possible to that of the hot water as the two pass through the heat exchanger.

In determining the best range of vaporization temperatures, several factors must be considered. The lower the initial boiling point of the working fluid, the colder the discharge hot water can be, and thus the more heat from the hot water can be utilized. This of course increases the efficiency of the system by allowing a smaller quantity of water to be used to vaporize a given quantity of working fluid, and this is in fact the primary advantage of the countercurrent type heat exchanger.

However the initial boiling point must not be too low or it will reduce the efficiency of the system in another way. For example if the hot water discharge temperature were 100° F., and the condenser water such that condensation was to be carried out at about 100° F. also, it would not be practical to use a working fluid with an initial boiling point of 100°. If this were done, it would be necessary to maintain the pressure in the condenser substantially equal to that in the heat exchanger for complete condensation of the working fluid to take place. However there would then be negligible expansion of the working fluid and thus no power would be produced by the system. Thus the initial vaporization temperature must be substantially higher than the initial temperature of the cooling fluid.

On the other hand, if the initial boiling point is very high, i.e. at or near the initial temperature of the hot water, the working fluid will have an ideal wide expansion ratio allowing low condenser pressure. However this extreme too is grossly inefficient because the heat of the hot water is utilized only at its highest temperature so that large quantities of water are needed to vaporize the working fluid.

Figure 6:
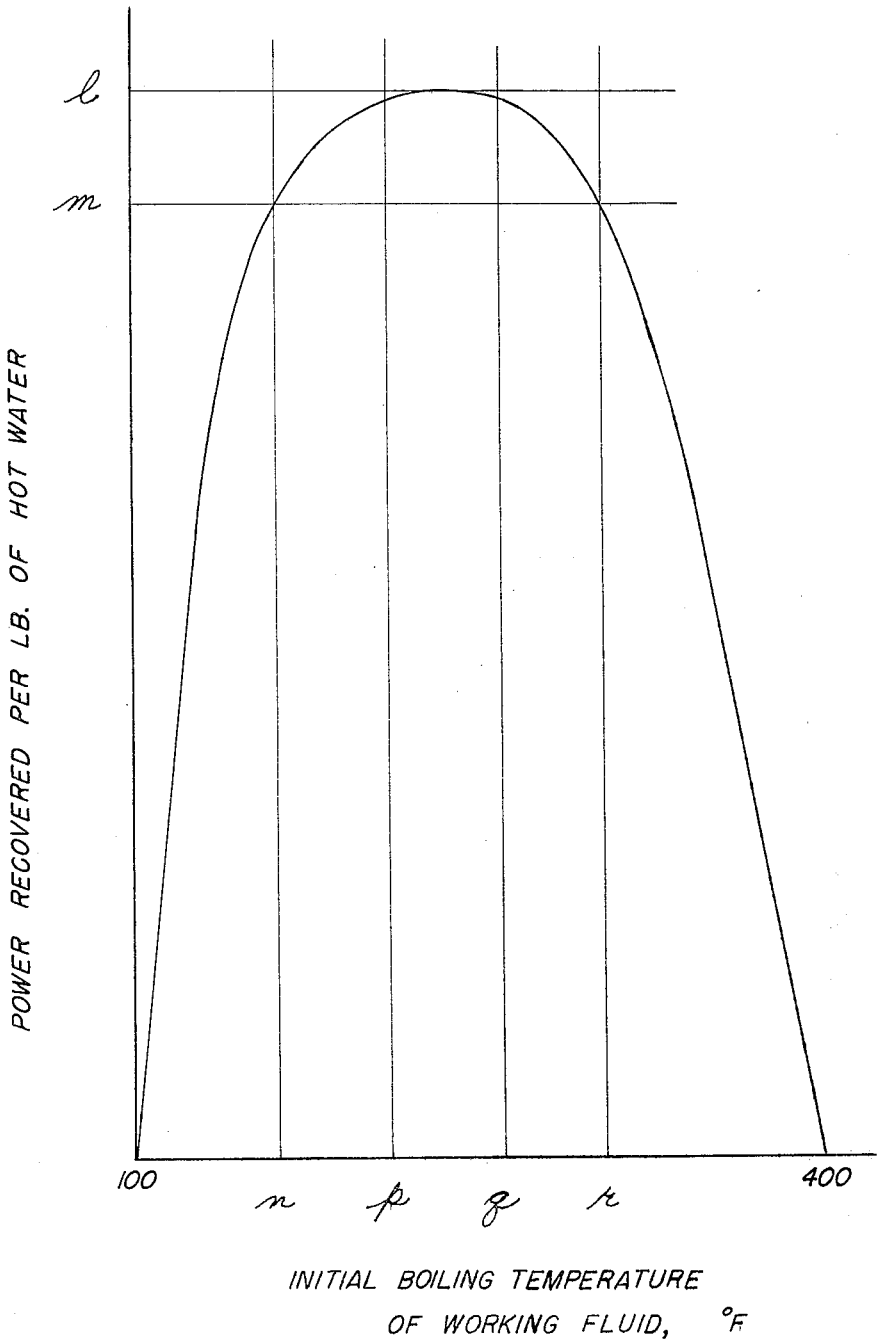
FIG. 6 is a graph showing power recovery for hydrocarbon mixtures of various initial boiling temperatures.

The choice of a range of vaporization temperatures must thus be made by balancing these factors, which are illustrated graphically in FIG. 6. It has been found that for most systems using hydrocarbon working fluids, the choice is generally reduced to selection of an appropriate initial boiling point which is between the initial temperature of the condenser water and the initial temperature of the hot water. Given such an initial boiling point, the desired range for hydrocarbons extends up to a final boiling temperature slightly below the initial temperature of the hot water.

FIG. 6 shows power recoverd per pound of hot water plotted on an arbitrary scale against working fluid initial boiling temperatures. The curve is an approximation for an hypothetical system having typical pressures, component sizes, etc. The spread of temperatures from 100° F. to 400° F. represents the spread between the initial temperatures of the heating and cooling fluids as they enter their respective parts of the hypothetical system. Each point on the curve represents a hydrocarbon mixture having the initial boiling temperature indicated by the graph and a final boiling temperature slightly below 400° F.

The curve of FIG. 6 illustrates the facts stated above, namely that an initial working fluid boiling temperature near the initial condenser water temperature, i.e. 100°, or the initial heat exchanger water temperature, i.e. 400°, yields unacceptably low power recovery. The graph also shows that an initial working fluid boiling temperature about 0.4 to 0.55 of the spread between these extremes yields optimum power recovery at the general level of line 1 on the graph. Since the curve does not form a sharp peak, but has on the contrary rather a large radius of curvature near line 1, the initial boiling temperature of the working fluid can, without significant variation of the power recovery, fall anywhere from about 0.4 to 0.55 of the spread between the temperature extremes for the system. These limits for optimum power recovery are indicated by the vertical lines p and q respectively.

It will be readily appreciated that these limits could be extended and excellent power recovery would still be achieved. For example, points above line m on the curve represent 90% of the optimum possible power recovery. Thus the initial boiling point could fall anywhere from about 0.22 to 0.7 of the spread between the system extremes and still yield excellent power recovery as indicated by the vertical lines n and r. These limits are only exemplary and, while practical for a typical system, they could be varied somewhat depending on the amount of power recovery desired.

Although FIG. 6 is based on a particular hypothetical system having temperature extremes of 100° and 400°, it has been found that virtually any system will give the same general type of curve for hydrocarbon working fluids. Thus, for a hydrocarbon mixture according to the invention the initial boiling temperature should generally fall between 0.22 and 0.7 of the spread between the initial temperatures of the heating and cooling fluids and preferably from 0.4 to 0.55 of the spread between these extremes. While hydrocarbons appear at present to be the most promising source of ingredient fluids, other substances might be used and similar curves and relationships indicative of the best choice of initial boiling temperature could be made for these materials.

Such a choice of initial boiling temperature assumes a condenser pressure which is considerably lower than that of the heat exchanger but sufficiently elevated that the temperature range in the condenser is large enough, i.e. the slope of the T-H curve is steep enough, to keep the required volume of condenser water reasonably small. Furthermore, such a range allows the condenser's initial working fluid temperature to be kept reasonably high. Thus the volume of gas flowing out of the turbine is relatively small by virtue of the fact that it need not be completely expanded. This provides economic advantages by keeping the necessary sizes of the turbine and the condenser pipes relatively small.

Another important point is that power recovery per pound of hot water is excellent for hydrocarbon working fluids with initial boiling temperatures anywhere from about 0.22 to about 0.7 of the spread between the initial temperatures of the heating and cooling fluids. Even for initial boiling temperatures which yield optimum results, there is a rather wide choice, i.e. from 0.4 to 0.55 of the spread. This means that the engineer has a wide choice of initial boiling temperatures and thus a wide choice of equipment size, operating conditions, etc. In practice it implies that he can, within liberal limits, design a system and then "tailor make" a working fluid to fit it. The particular equipment, e.g. size of turbine, etc., which he selects for his system will determine the precise range of temperatures, within the broad limits, over which the working fluid should vaporize. Given this desired range, he can prepare a fluid which will vaporize over the range by known empirical and mathematical methods.

The solid line $AB_3C_3D_3E_3F_3$ in FIG. 2 represents an exemplary working fluid according to the invention, a 35 Mol percent solution of isobutane in propane, as it passes through a power system being introduced at about 100° F. and the same pressure as isobutane and propane in the above examples. The solid line $X_3Y_3$ represents the corresponding water in the heat exchanger, introduced at 325° F., and the line $WZ_3$ represents the water in the condenser. Segment $AB_3$ represents preheating, segment $B_3C_3$ vaporization, segment $C_3D_3$ superheating, segment $D_3E_3$ expansion, segment $E_3F_3$ cooling, and segment $F_3A$ condensation of the mixture. The segment $AB_3C_3D_3$ is more nearly linear than either $AB_1C_1D_1$ or $AB_2C_2D_2$; i.e. its slope, representing its rate of change of temperature with respect to enthalpy, is more nearly constant than that of either propane or isobutane alone. This is because the mixture vaporizes over a continuous range of temperatures, about 200° F. to 250° F., and does not form a horizontal plateau. Segment $AB_3C_3D_3$ is also more nearly parallel to $X_3Y_3$ than $AB_1C_1D_1$ is to $X_1Y_1$ or $AB_2C_2D_2$ is to $X_2Y_2$. This means that the temperature difference between the mixture and the hot water in this system varies less than do the temperature differences between hot water and isobutane and between hot water and propane in the other systems. Of course, all three systems show relatively great differences at and near their respective low temperature points in the heat exchanger. Insofar as the temperature difference between the hot water and the working fluid cannot be truly constant, it is better for the greatest difference to occur where the working fluid enters the heat exchanger.

It will also be noted that the temperature at the initial boiling point $B_3$ is about 0.44 of the spread between the temperatures at $Z_3$ and $Y_3$. The range of vaporization temperatures extends upward from $B_3$ to the point $C_3$ slightly below $Y_3$. Thus the mixture's range of vaporization temperatures falls in the optimum area for system efficiency and power recovery as described above.

Comparing lines $X_1Y_1$, $X_2Y_2$, and $X_3Y_3$ it can readily be seen that line $X_3Y_3$ is shorter, has a shorter enthalpy range, and has a greater (steeper) slope than either of the other two lines. This evidences the fact that less hot water is needed in the system using the mixture as working fluid than in either of the systems using a single ingredient working fluid since the heat from the water is more efficiently used. The shortness of line $X_3Y_3$ shows that less water is used, and the steeper slope and shorter enthalpy range indicate a more efficient use of the available heat.

Advantages are also realized in the cooling-condensation part of the system. Segment $F_3A$ is not horizontal like segments $F_2A$ and $F_1A$ but has a positive slope (from left to right) since the mixture condenses over a continuously decreasing range of temperatures. The advantages of this are confirmed by the fact that line $WZ_3$ is shorter and of greater slope than lines $WZ_1$ and $WZ_2$, i.e. in the system using the mixture as the working fluid, less cooling medium is needed since it can be used more efficiently. Also the temperature differences in the condenser are more nearly constant with the mixture as evidenced by the fact that the vertical distance from $E_3$ to $Z_3$ is less than that from $E_1$ to $Z_1$ or $E_2$ to $Z_2$.

It has also been found that, due to a somewhat lower latent heat, the expansion ratio of the mixture is somewhat less than those of isobutane and propane alone. Therefore the expansion engine can be simpler mechanically, and thus less expensive, when the mixture is used.

Figure 5:
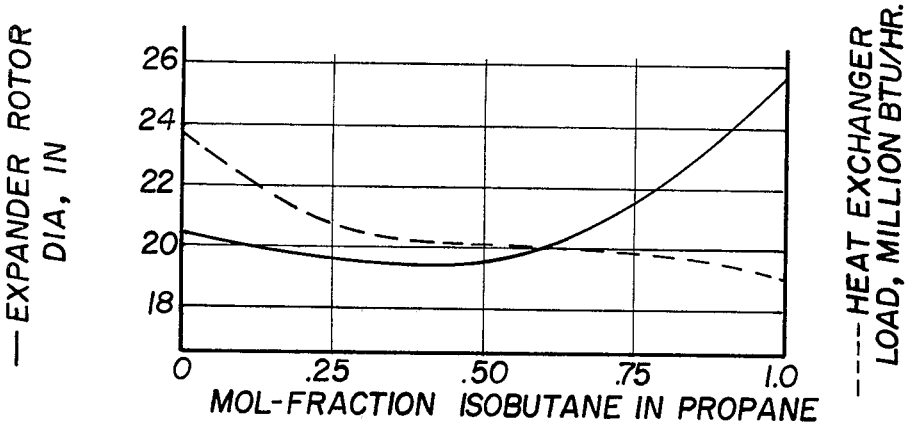
FIG. 5 is a graph showing further criteria for determining the most advantageous proportions for mixing isobutane and propane.
Figure 4:
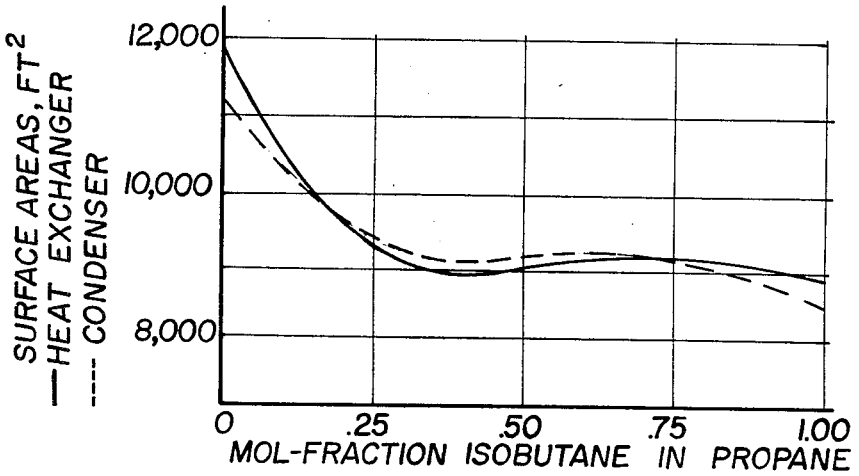
FIG. 4 is a graph showing further criteria for determining the most advantageous proportions for mixing isobutane and propane.
Figure 3:
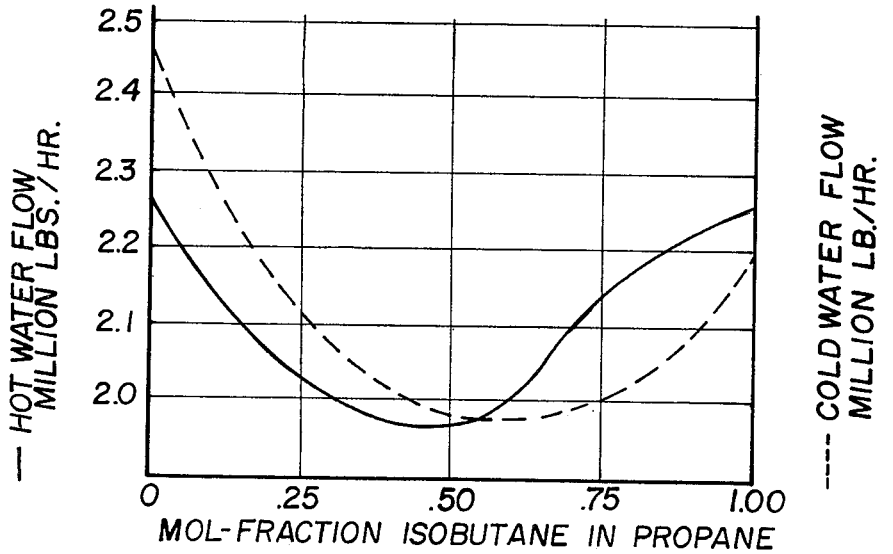
FIG. 3 is a graph showing criteria for determining the most advantageous proportions for mixing isobutane and propane.

Referring now to FIGS. 3, 4 and 5, a series of graphs are shown depicting criteria for determining the most advantageous proportions for mixing isobutane in propane. Each of these figures shows one graph with two curves on each graph. All of the curves in FIGS. 3, 4, and 5 are plotted against the same abscissa and the figures are aligned for comparison sake, the abscissa being the Mol fraction of isobutane in propane. The ordinates of the graphs are various factors which should be minimized as much as possible. All curves are plotted for a fixed power ourput of 15,000 HP.

In FIG. 3, the flow of hot water (in the heat exchanger) in millions of pounds per hour is plotted against the abscissa in the solid line curve, while the flow of cold water (in the condenser) in millions of pounds per hour is plotted in the dashed line curve.

In FIG. 4 the surface areas in square feet of the heat exchanger and condenser, in solid and dashed lines respectively, are plotted against the abscissa.

In FIG. 5 the rotor diameter, in inches, of a turbine being used for the expansion engine, and the heat exchanger load, in millions of British Thermal Units per hour, are plotted, in solid and dashed lines respectively, against the abscissa.

For maximum efficiency and minimum cost of a power system, a Mol fraction of isobutane in propane should be chosen which provides an optimum yielding near minimum values for all six of the curves taken together. A mixture between 0.35 and 0.50 isobutane in propane is seen to be an optimum working fluid since all six curves have low ordinate values in this range. The precise Mol fraction chosen is determined according to which of the six factors: hot water flow, cold water flow, heat exchanger surface, condenser surface, turbine rotor diameter, or heat exchanger load is most important or crucial in a given situation. In the above example, shown in FIG. 2, a Mol fraction of 0.35 or 35% isobutane in propane was used.

As stated above, the ingredients isobutane and propane are used only as examples and many other ingredient fluids may be used in practicing the invention provided they can be mixed. For example, if the desired range of vaporization temperatures, determined as described above, were higher than that of the example, ingredients such as butane and pentane might be used.

It is also possible to use more complicated mixtures involving three or more ingredient fluids to approach a constant temperature difference between hot water and working fluid as closely as desired or to approach a constant difference more closely in the more important ranges of temperature. However, in these more complicated embodiments the criteria for determining what ingredient fluids are suitable and in what proportion to mix them are essentially the same as in the isobutane-propane example.

I claim:

1. In a process for converting thermal energy to mechanical energy wherein a working fluid is pre-heated and vaporized by being passed through a heating zone in countercurrent heat exchange relation with a heating fluid, said working fluid is expanded to produce mechanical energy, and said working fluid is cooled and condensed, the improvement comprising:

using as said working fluid a mixture of ingredient fluids having moderately close but essentially different boiling points such that said working fluid vaporizes over a desired range of substantially continuously increasing vaporization temperatures, wherein for a substantial increase in enthalpy of said working fluid as it passes through said heating zone there is a substantial increase in temperature of said working fluid, and the differences in temperature between said working fluid and said heating fluid at each point in said heating zone are more nearly equal than would be the differences in temperature between any of said ingredient fluids and said heating fluid at each point in said heating zone were said ingredient fluids passed individually through said heating zone in counter-current heat exchange relation with said heating fluid;

maintaining substantially constant the respective compositions of said working fluid and said heating fluid throughout said heating zone;

and further maintaining said heating fluid in substantially a single phase throughout said heating zone.

2. The process of claim 1 wherein said working fluid is cooled and condensed by being passed through a cooling zone in heat exchange relation with a cooling fluid and wherein the lowest temperature in said range of vaporization temperatures is substantially higher than the initial temperature of said cooling fluid, and the highest temperature in said range of vaporization temperatures is slightly lower than the initial temperature of said heating fluid.

3. The process of claim 1 including the step of superheating said working fluid in said heating zone.

4. The process of claim 1 wherein the relation between temperature and enthalpy of said working fluid as it passes through said heating zone is more nearly linear than would be the relation between temperature and enthalpy of any of said ingredient fluids were they passed individually through said heating zone.

5. The process of claim 2 wherein the difference in temperature between said working fluid and said heating fluid at a point of highest temperatures in said heating zone is less than the difference in temperature between said working fluid and said heating fluid at a point of lowest temperatures in said heating zone.

6. The process of claim 1 wherein said ingredient fluids are hydrocarbons.

7. The process of claim 1 wherein said working fluid is cooled and condensed by being passed through a cooling zone in countercurrent heat exchange relation with a cooling fluid, said working fluid condensing over a desired range of decreasing temperatures.

8. The process of claim 7 wherein the differences in temperature between said working fluid and said cooling fluid at each point in said cooling zone are more nearly equal than would be the differences in temperature between any of said ingredient fluids and said cooling fluid at each point in said cooling zone were said ingredient fluids passed individually through said cooling zone.

9. The process of claim 2 wherein said lowest temperature in said range of vaporization temperatures falls between predetermined lower and upper limits, said limits defining a set of values for which the process yields a desired amount of power per unit mass of heating fluid.

10. The process of claim 9 wherein said ingredient fluids are hydrocarbons, wherein said initial temperature of the cooling fluid and said initial temperature of the heating fluid define respective lower and upper extremes of a temperature spread, and wherein said lower limit is higher than said lower extreme by a value equal to 0.22 of said spread and said upper limit is higher than said lower extreme by a value equal to 0.7 of said spread.

11. The process of claim 9 wherein said ingredient fluids are hydrocarbons, wherein said initial temperature of the cooling fluid and said initial temperature of the heating fluid define respective lower and upper extremes of a temperature spread, and said lower limit is higher than said lower extreme by a value equal to 0.4 of said spread and said upper limit is higher than said lower extreme by a value equal to 0.55 of said spread.

12. The process of claim 1 wherein said heating fluid is substantially aqueous.

* * * * *